US011147147B2

(12) United States Patent
Meerbeek et al.

(10) Patent No.: US 11,147,147 B2
(45) Date of Patent: Oct. 12, 2021

(54) SYSTEM FOR CONFIGURING A LIGHTING DEVICE

(71) Applicant: SIGNIFY HOLDING B.V., Eindhoven (NL)

(72) Inventors: Berent Willem Meerbeek, Veldhoven (NL); Gerhardus Engbertus Mekenkamp, Valkenswaard (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/254,891

(22) PCT Filed: Jun. 13, 2019

(86) PCT No.: PCT/EP2019/065547
§ 371 (c)(1),
(2) Date: Dec. 22, 2020

(87) PCT Pub. No.: WO2020/001998
PCT Pub. Date: Jan. 2, 2020

(65) Prior Publication Data

US 2021/0212187 A1 Jul. 8, 2021

(30) Foreign Application Priority Data

Jun. 26, 2018 (EP) ..... 18179776

(51) Int. Cl.
*H05B 47/19* (2020.01)

(52) U.S. Cl.
CPC ..... *H05B 47/19* (2020.01)

(58) Field of Classification Search
CPC .... H05B 47/19; H05B 47/105; H05B 47/155; H05B 45/20; H05B 47/115; H05B 47/175;

(Continued)

(56) References Cited

U.S. PATENT DOCUMENTS 9,784,417 B1 10/2017 Springer
9,820,361 B1 11/2017 Turvy, Jr. et al.

(Continued)

FOREIGN PATENT DOCUMENTS

WO 2013034361 A1 3/2013
WO 2017207321 A1 12/2017
WO 201904827 A1 1/2019

*Primary Examiner* — Monica C King

(57) ABSTRACT

A lighting device (100) is disclosed. The lighting device (100) comprises a light source (102), a first communication module (104) configured to communicate via a first wireless communication technology, and configured to receive a lighting control command from a lighting control device via the first wireless communication technology, a second communication module (106) configured to communicate via a second wireless communication technology, and configured to receive a configuration command from a configuration device via the second wireless communication technology, wherein the configuration command comprises information related to a second light setting, a memory (108), a processor (110) configured to control the light source (102) according to a first light setting associated with the lighting control command upon receiving the lighting control command from the lighting control device, wherein the processor (110) is further configured to store an association between the second light setting and the lighting control command in the memory (108) upon receiving the configuration command, and wherein the processor (110) is further configured to control the light source (102) according to the second light setting upon receiving the same lighting control command after the association has been stored.

15 Claims, 4 Drawing Sheets

(58) Field of Classification Search
CPC ..... H05B 47/11; H05B 45/22; H05B 47/195; H05B 47/22; H05B 45/10; H05B 47/125; H05B 47/16; H05B 47/165; H05B 45/00; H05B 45/12; H05B 45/14; H05B 45/30; H05B 47/10; H05B 47/12; H05B 47/14; H05B 47/18; H05B 33/08; H05B 41/36; H05B 41/3921; H05B 45/18; H05B 45/24; H05B 45/28; H05B 45/325; H05B 45/345; H05B 45/48; H05B 47/13; H05B 47/135; H05B 47/17; H05B 47/185; H05B 47/20
See application file for complete search history.

(56) References Cited

U.S. PATENT DOCUMENTS

| | | | | |
|---|---|---|---|---|
| 2016/0295669 | A1 | 10/2016 | Thijssen | |
| 2018/0116042 | A1 | 4/2018 | Roosli | |
| 2018/0158460 | A1 | 6/2018 | Lee et al. | |
| 2020/0036569 | A1* | 1/2020 | Mekenkamp | H04L 29/08 |
| 2020/0314980 | A1* | 10/2020 | Van De Sluis | H05B 45/12 |

* cited by examiner

SYSTEM FOR CONFIGURING A LIGHTING DEVICE

CROSS-REFERENCE TO PRIOR APPLICATIONS

This application is the U.S. National Phase application under 35 U.S.C. § 371 of International Application No. PCT/EP2019/065547, filed on Jun. 13, 2019, which claims the benefit of European Patent Application No. 18179776.2, filed on Jun. 26, 2018. These applications are hereby incorporated by reference herein.

FIELD OF THE INVENTION

The invention relates to a lighting device and to a system for configuring the lighting device. The invention further relates to a method of configuring a lighting device, and to a computer program product for executing the method.

BACKGROUND

Connected home and office lighting systems enable users to control the light output of lighting devices with their smartphones, light switches and other lighting control devices. Current systems often use a single communication technology, such as Bluetooth or ZigBee. In systems that use a point-to-point communication technology such as Bluetooth or Wi-Fi, lighting control devices or mobile devices directly communicate with the lighting devices. In systems that use a multi-hop (mesh network) communication technology such as ZigBee, a mobile device may first communicate lighting control commands via a first communication technology, such as Wi-Fi, to a bridge, whereupon the bridge communicates the lighting control commands to the lighting devices via a second communication technology such as ZigBee. In this multi-hop system, light switches may communicate lighting control commands to the lighting devices via ZigBee, either directly or via multiple hops via multiple ZigBee devices.

If a user would want to combine two systems that use different communication technologies, a user's mobile device may not be able to (directly) communicate with a lighting device via one of these communication technologies (e.g. ZigBee). Additionally, a light switch may not be able to communicate with the lighting device via another communication technology (e.g. Bluetooth). A solution to this problem is to provide the lighting device with two communication modules configured to communicate via both communication technologies.

U.S. Pat. No. 9,820,361 B1 discloses a networked lighting control system wherein each lighting control device includes a dual-band wireless radio communication interface system. The dual-band wireless radio communication interface system is configured for unicast and multicast communication over a first of two different wireless communication bands as well as point-to-point communication over a second wireless communication band. The standalone intelligence control node can be a wall switch or detector. Commissioning and provisioning of the lighting control system is performed over the second communication band via communications with a mobile device and lighting controls are carried out over the first communication band.

SUMMARY OF THE INVENTION

The inventors have realized that if a user would want to configure a lighting control device that is configured to communicate with a lighting device via a first communication protocol with a lighting control device (such as a light switch) that is configured to communicate with the lighting device via a second communication protocol, the configuration commands need to be relayed by a bridge device to the switch.

It is an object of the present invention to reduce computing resources and/or network resources during the configuration of a lighting control device with a mobile device that uses a different communication technology than the lighting control device.

According to a first aspect of the present invention, the object is achieved by a lighting device comprising:

- a light source,
- a first communication module configured to communicate via a first wireless communication technology, and configured to receive a lighting control command from a lighting control device via the first wireless communication technology,
- a second communication module configured to communicate via a second wireless communication technology, and configured to receive a configuration command from a configuration device via the second wireless communication technology, wherein the configuration command comprises information related to a second light setting,
- a memory,
- a processor configured to control the light source according to a first light setting associated with the lighting control command upon receiving the lighting control command from the lighting control device, wherein the processor is further configured to store an association between the second light setting and the lighting control command in the memory upon receiving the configuration command, and wherein the processor is further configured to control the light source according to the second light setting upon receiving the same lighting control command after the association has been stored.

The lighting device comprises a memory, which is configured to store at least an association between the second light setting and the lighting control command. The processor is configured to store this association based on the received configuration command. The configuration command is received from a configuration device such as a smartphone, a tablet pc, a home control system, etc. After the processor has stored the association, the lighting device will be controlled according to the light setting associated with the unchanged lighting control command when the lighting control device (e.g. a light switch) is actuated by a user. Thus, from a user's perspective, it seems that the lighting control device has been reconfigured, while actually the lighting device has been reconfigured. Only configuring the lighting device is beneficial because it is no longer required to relay a configuration command from the configuration device—which is configured to communicate via a certain communication technology—to a lighting control device—which is configured to communicate via a different communication technology. Thus, computing resources at the switch device (and at a possible bridge device) are reduced during the configuration of the lighting control device. Also, a bridge device is no longer necessary. Additionally, network resources are reduced because less network traffic is required to configure how the lighting device responds to the lighting control device.

The second communication module may be configured to receive a request message from the configuration device, and the second communication module may be further configured to communicate information related to a current configuration of the lighting device to the configuration device, wherein the current configuration may relate to at least one current association between a light setting and a lighting control command. This enables the configuration device to request how the lighting device (and the corresponding lighting control device) are configured, before it provides the configuration command to reconfigure the lighting device. Additionally, the configuration device may render the current configuration on a user interface to communicate the current configuration to a user operating the configuration device. The user interface may be configured to receive user input indicative of a selection of a light setting that is to be associated with the lighting control device, whereupon a configuration command based on that user input may be communicated to the lighting device.

The current configuration may further relate to properties of the lighting control device. Properties of the lighting control device may, for example, include a type of lighting control device, a communication protocol used by the lighting control device, a number of buttons or user interface elements of the lighting control device, types of buttons or user interface elements of the lighting control device, etc. The configuration device may use this information for determining the possibilities of assigning light settings to the lighting control device.

The memory may be configured to store the first light setting, and the processor may be configured to overwrite the stored first light setting with the second light setting. The memory may, initially, store an association between the lighting control command and the first light setting. After the configuration command has been received from the configuration device, the processor may overwrite the stored first light setting with the second light setting such that the second light setting is associated with the lighting control command.

Alternatively, the memory may be configured to store the first and the second light setting, and the processor may be configured to remove a link between the first light setting and the lighting control command and link the second light setting to the lighting control command upon receiving the configuration command. In other words, the processor may change with which light setting the lighting control command is associated (from the first to the second light setting). The memory may for example store a list of light settings. The processor may change the association between the lighting control command and any of the stored light settings based on the configuration command. These light settings may for example be predefined light settings, user defined light settings, dynamically/automatically generated light settings, etc.

The processor may be configured to change the light output of the lighting device after the association has been stored to indicate to a user that the association has been stored. This is beneficial because it shows a user that the new association has been stored, and that the reconfiguration is successful.

The first light setting may be associated with a first lighting control command of a first lighting control device and with a second lighting control command from a second lighting control device, and the processor may be configured to control the light source according to the first light setting upon receiving the first or the second lighting control command, and the configuration command may further comprise an indication that the second light setting is to be associated with the second lighting control device, and the processor may be further configured to store or maintain a first association between the first light setting and the first lighting control command and store a second association between the second light setting and the second lighting control command in the memory upon receiving the configuration command, and the processor may be further configured to, after the association has been stored, control the light source according to the first light setting upon receiving the first lighting control command from the first lighting control device and to control the light source according to the second light setting upon receiving the second lighting control command from the second lighting control device. In other words, when two lighting control commands from two different lighting control devices are associated with the same light setting, the configuration device may reconfigure the lighting device such that one of the switches will control the lighting device according to the second light setting, while maintaining the association between the other switch and the first light setting. Alternatively, the configuration command may comprise instructions to associate the first and second lighting control command with the second light setting, and the processor may be configured to associate the first and second lighting control command (of the first and second lighting control devices) with the second light setting.

The first wireless communication technology may be a multi-hop communication technology (such as ZigBee, Thread, WirelessHART, SmartRF, Bluetooth Mesh, or any other mesh or tree-based technology), and wherein the wireless communication technology is a point-to-point communication technology (such as Bluetooth, Bluetooth Low Energy (BLE), Infrared (IR), near field communication (NFC), wireless local area communication (Wi-Fi), etc.).

The lighting control command may be received from the lighting control device after actuation of a user input element of the lighting control device. The lighting control device may comprise one or more sensors or buttons configured to be actuated (pushed, rotated, touched, voice command, etc.) by a user, whereupon the lighting control command may be transmitted from the lighting control device to the lighting device.

The configuration device may be a (portable) mobile user device, such as a smartphone, a tablet pc, a smart home system, etc.

The second light setting may be a dynamic light setting. A dynamic light setting may be a light setting that changes its light output over time. The dynamic light setting may be a sequence of light settings that transition into each other over time. It is beneficial to store such a dynamic light setting in the memory of the lighting device, as this removes the need of transmitting the individual light settings to the lighting device over time.

According to a second aspect of the present invention, the object is achieved by a system for configuring a lighting device, the system comprising the lighting device according to any above-mentioned lighting device, and a lighting control device configured to transmit a lighting control command to the lighting device via the first wireless communication technology. The system may further comprise the configuration device, comprising a user interface configured to receive a user input indicative of a selection of a second light setting, and a transmitter configured to transmit a configuration command comprising information related to the second light setting to the lighting device.

According to a third aspect of the present invention, the object is achieved by a method of configuring a lighting device comprising a light source and a memory, the method comprising:

receiving a lighting control command from a lighting control device via a first wireless communication technology, controlling the light source according to a first light setting associated with the lighting control command upon receiving the lighting control command from the lighting control device, receiving a configuration command from a configuration device via a second wireless communication technology, wherein the configuration command comprises information related to a second light setting, storing an association between the second light setting and the lighting control command in the memory upon receiving the configuration command, and controlling the light source according to the second light setting upon receiving the same lighting control command after the association has been stored.

According to a fourth aspect of the present invention, the object is achieved by a computer program product for executing the method.

It should be understood that the system, the method and the computer program product may have similar and/or identical embodiments and advantages as the above-mentioned lighting device.

BRIEF DESCRIPTION OF THE DRAWINGS

The above, as well as additional objects, features and advantages of the disclosed systems, devices and methods will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
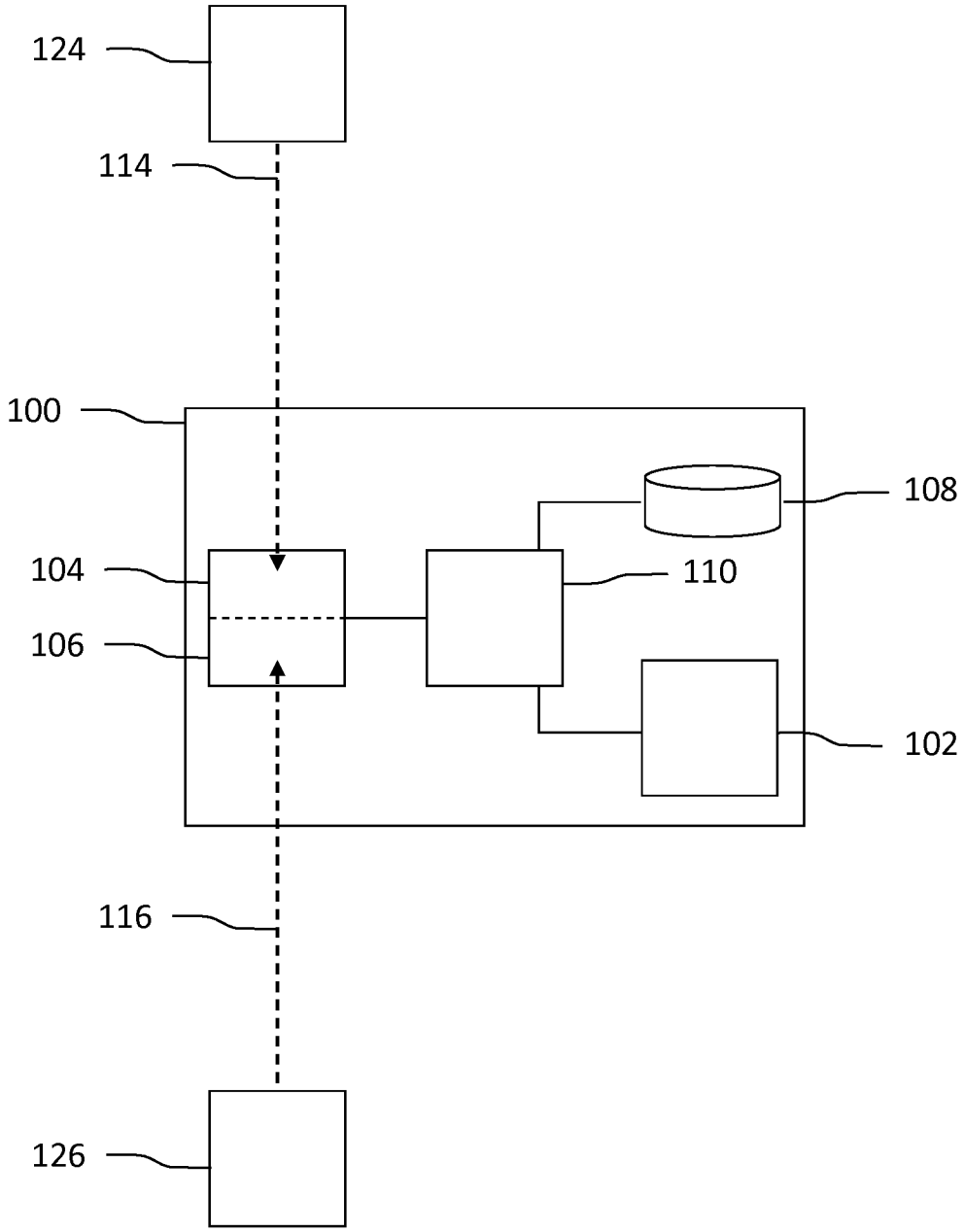
FIG. 1 shows schematically an embodiment of a system for configuring a lighting device.

FIG. 1 shows schematically an embodiment of a system for configuring a lighting device 100. The system comprises the lighting device 100, a lighting control device 124 and a configuration device 126. In this system, the configuration device 126 is unable to communicate directly with the lighting control device 124, as the lighting control device 124 is configured to communicate via a first communication technology 114 that is not present in the configuration device 126. The lighting device 100 comprises a controllable (LED) light source. The lighting device 100 further comprises a first communication module 104 configured to communicate via a first wireless communication technology 114, and configured to receive a lighting control command from the lighting control device 124 via the first wireless communication technology 114. The lighting device 100 further comprises a second communication module 106 configured to communicate via a second wireless communication technology 126, and configured to receive a configuration command from a configuration device 126 via the second wireless communication technology 116 (different from the first communication technology 114). The configuration command comprises information related to a second light setting. The lighting device 100 further comprises a memory 108 configured to store associations between light settings and lighting control commands (which can be received from lighting control devices). The lighting device 100 further comprises a processor 110 (e.g. a microcontroller, a microchip, circuitry, etc.) configured to control the light source 102 according to a first light setting associated with the lighting control command upon receiving the lighting control command from the lighting control device 124. The processor 102 is further configured to store an association between the second light setting and the lighting control command in the memory 108 upon receiving the configuration command, and to control the light source 102 according to the second light setting upon receiving the same lighting control command from the lighting control device 124 after the association has been stored in the memory 108.

The lighting control device 124 may be a lighting control device, such as a switch or a sensor, comprising one or more input elements configured to receive a (user) input. Examples of such input elements comprise buttons, touch-sensitive surfaces, rotary knobs, etc. In embodiments, lighting control device 124 may, for example, comprise a sensor for receiving the input. The sensor may for example be a presence sensor, an audio sensor, a touch sensor, a camera, etc. for detecting the input. The lighting control device 124 may for example be a switch comprising a first button and a second button. A user may select one of the buttons whereupon a first or a second lighting control command will be transmitted from the switch to the lighting device 100 via the first communication protocol 114.

The lighting control device 124 comprises a transmitter configured to transmit a lighting control command to the lighting device 100 via the first wireless communication technology 114. The lighting control device may comprise a processing unit configured to generate the lighting control command. The processing unit may be configured to generate the lighting control command based on a type of user input that is detected via the one or more user input elements. For example, the processing unit may generate the lighting control command based on which user input element has been actuated and/or based on how a certain user input element is actuated. The lighting control command may, for instance, be dependent on a duration of a pressing of a button and/or be dependent on a sequence of pressings of a button.

The configuration device 126 may be any device for configuring a lighting device. Examples of configuration devices 126 comprise smartphones, smart watches, tablet PCs, PCs, home automation/control systems, voice assistant, etc. The configuration device 126 may comprise a transmitter configured to transmit the configuration command via the second wireless communication technology 116 (different from the first communication technology 114) to the lighting device 100.

The configuration device 126 may comprise a user interface configured to receive a user input indicative of a selection of the second light setting. The user interface may, for example, be a (touch) display configured to provide information about a current configuration of the lighting device 100 and the lighting control device 124. The current configuration may relate to at least one current association between a light setting and a lighting control command of a respective control device 124. The configuration device 126 may, for example, provide a light setting selector (e.g. a color picker, a light scene selector, etc.) on the user interface. The user interface may further provide information about a current light setting that is associated with a user input element of the lighting control device 124. A light setting, for example a red color, may be associated with a button of a light switch such that when the button is actuated the lighting device 100 will be controlled according to the red color. The user interface may for instance display this light setting and the button of the switch, and a user may select a new light setting for the button (e.g. a green color).

The configuration device 126 may be configured to transmit a request message, via the second communication technology 116, to the lighting device 100 in order to request information regarding the current configuration of the lighting device 100. The second communication module 106 of the lighting device 100 may be configured to receive the request message from the configuration device 126, whereupon the second communication module may communicate information related to the current configuration of the lighting device 100 to the configuration device 126. The request message may be sent automatically by the configuration device 126, for instance when the configuration device 126 is set to a configuration mode.

The current configuration may further relate to properties of the lighting control device 124. Properties of the lighting control device 124 may, for example, include a type of lighting control device 124, a communication protocol used by the lighting control device 124, a number of buttons or user input elements of the lighting control device 124, a type of buttons or user input elements of the lighting control device 124, etc. The configuration device 126 may use this information for determining the possibilities of assigning light settings to the lighting control device 124. The configuration device 126 may, for example, request and receive information about a number of user input elements and light settings associated with these user input elements (and their respective lighting control signals). This enables the configuration device 126 to provide, via a user interface such as a display, information about associations between user input elements (e.g. buttons) of the lighting control device 124 and light settings.

The lighting device 100 may be any type of lighting device 100 arranged for receiving lighting control commands from a lighting control device 124 via the first communication protocol 114 and for receiving configuration commands from a configuration device 126 via the second communication protocol 126. The lighting device comprises a light source 102, for instance an LED light source. The lighting device 100 may be arranged for providing general lighting, task lighting, ambient lighting, atmosphere lighting, accent lighting, indoor lighting, outdoor lighting, etc. The lighting device 100 may be part of a luminaire or a lighting fixture. Alternatively, the lighting device 100 may be a portable/wearable lighting device (e.g. a hand-sized device, such as an LED cube, an LED sphere, an object/animal shaped lighting device, etc.).

The lighting device 100 comprises the first communication module 104 and the second communication module 106. The first communication module 104 is configured to communicate via a first wireless communication technology 114, for instance a first network technology such as ZigBee, and the second communication module 106 is configured to communicate via a second wireless communication technology 116, for instance a second network technology such as BLE. These modules 104, 106 may be separate units (e.g. separate radio chips) in the lighting device or both comprised on a single radio chip, allowing a low-cost device to operate as part of both a first network and a second network at the same time, leveraging a single wireless radio module. This may be achieved by fast switching the first and second communication technology (e.g. ZigBee and BLE) operations over time such that the device remains connected and operates in both networks simultaneously. The possibility of having a constrained device operating simultaneously on two networks opens up new solutions to improve the limitations of these existing technologies. BLE, for instance, is a low-power/low-cost wireless network technology enabling single-hop communication in a star topology between a master node and a limited number of power-constrained slave nodes. BLE provides energy-efficient connectivity between power-constrained slave devices and a less power-constrained master device. An example of a BLE network may consist of a mobile telephone device as master, which can provide Internet connectivity to an ecosystem of resource constrained devices such as sensors, wearables, and building automation devices.

In various embodiments of the present invention, BLE and ZigBee combined radio is used as an example for providing enhanced security. However, the present invention is equally applicable to any other combination of wireless communication technologies (e.g. BLE, Infrared (IR), near field communication (NFC), wireless local area communication (Wi-Fi), ZigBee, Thread, WirelessHART, SmartRF, etc.).

The memory 108 of the lighting device 100 is configured to store associations between light settings and lighting control commands which are to be received from respective lighting control devices 124. The memory 108 may, for example, store a lookup table comprising these associations. The processor 110 may be configured to control the light source 102 of the lighting device 100 according to a light setting that is associated with a lighting control command received from the lighting control device 124 by accessing the associations (e.g. the lookup table) in the memory 108.

The memory 108 may be configured to store the first light setting, and the processor 110 may be configured to overwrite the stored first light setting with the second light setting. The memory may, initially, store an association between the lighting control command (that can be received from the lighting control device 124) and the first light setting. After the configuration command has been received from the configuration device 126, the processor 110 may overwrite the stored first light setting with the second light setting such that the second light setting is associated with the same lighting control command (that can be received from the same lighting control device 124).

Alternatively, the memory 108 may be configured to store the first and the second light setting, and the processor 110 may be configured to remove a link between the first light setting and the lighting control command and link the second light setting to the lighting control command upon receiving the configuration command. In other words, the processor 110 may change a link to the lighting control command (that can be received from the lighting control device 124) from the first light setting to the second light setting. The memory 108 may for example store a list of light settings. The processor 110 may change the association between the lighting control command and any of the stored light settings based on the configuration command received from the configuration device 126. After the link has been changed, the second light setting is associated with the same lighting control command (that can be received from the lighting control device 124).

In embodiments the lighting control command may comprise light setting information related to the first light setting. The processor 110 may be configured to retrieve the first light setting from the lighting control command and control the light source 102 according to the first light setting after the retrieval. After the processor 110 has received the configuration command, and after the processor 110 has stored the association between the second light setting and the lighting control command, the processor 110 may be configured to ignore the light setting information comprised in the lighting control command, and control the light source 102 according to the second light setting upon receiving the lighting control command. Thus, the lighting control command does not change and still comprises the first light setting, but the processor 110 no longer controls the light source 102 according to the first light setting after the association between the lighting control command and the second light setting has been stored.

The processor 110 may be configured to change the light output of the light source 102 of the lighting device 100 after the association has been stored to indicate to a user that the association has been stored. The processor 110 may, for instance, control the light source such that it (briefly) blinks or change the light output to the second light setting, to confirm that the storing of the association has succeeded.

Figure 2:
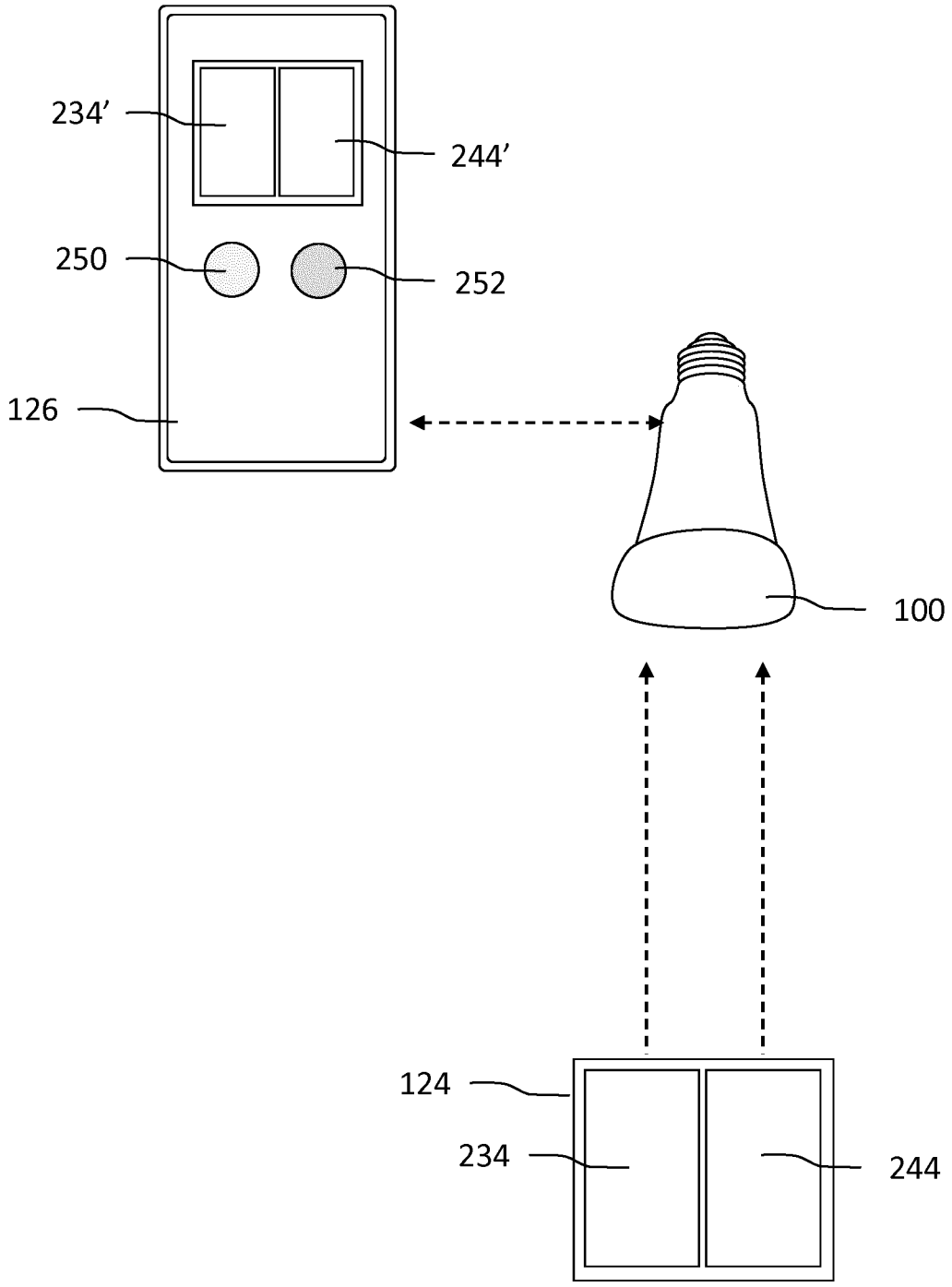
FIG. 2 shows schematically an embodiment of a system comprising a lighting device, a configuration device comprising a user interface and a lighting control device with two buttons.

FIG. 2 shows schematically an embodiment of a system comprising a lighting device 100, a configuration device 126 comprising a user interface (a display) and a lighting control device 124 with two user input elements 234, 244 (buttons in this example). The lighting control device 124, a light switch in this example, comprises a first user input element 234 and a second user input element 244. The processing unit of the lighting control device 124 may be configured to communicate a first lighting control command to the lighting device 100 when the first user input element 234 is actuated, and to communicate a second lighting control command to the lighting device 100 when the second user input element 244 is actuated. The processor (not shown) of the lighting device 100 may be configured to control the light source of the lighting device 100 according to a primary first light setting (e.g. red light) when the first lighting control command has been received, and to control the light source (not shown) of the lighting device 100 according to a secondary first light setting (e.g. green light) when the second lighting control command has been received. The configuration device 126 (e.g. a smartphone) may be configured to request a current configuration of the lighting device 126, and render current light settings associated with input elements of the lighting control device 124. FIG. 2 shows a first virtual representation 234' of the first user input element 234 and a second virtual representation 244' of the second user input element 244, and their corresponding configuration, wherein upon activation of the first user input element 234 the light source will be controlled according to a first color 250 (e.g. red) and wherein upon activation of the second user input element 234 the light source will be controlled according to a second color 252 (e.g. green). A user may, for instance, select one of the colors, for example the first color, and change that color with a color picker. The configuration device 126 may then send a configuration command to the lighting device 100 comprising information regarding the changed first color (e.g. from red to blue). The processor of the lighting device 100 may then store an association between the first user input element 234 (and its corresponding first lighting control command) and the changed first color (e.g. blue) in the memory. As a result, the light source would be controlled according to the changed first color (e.g. blue light) when a user would actuate the first user input element 234.

Figure 3:
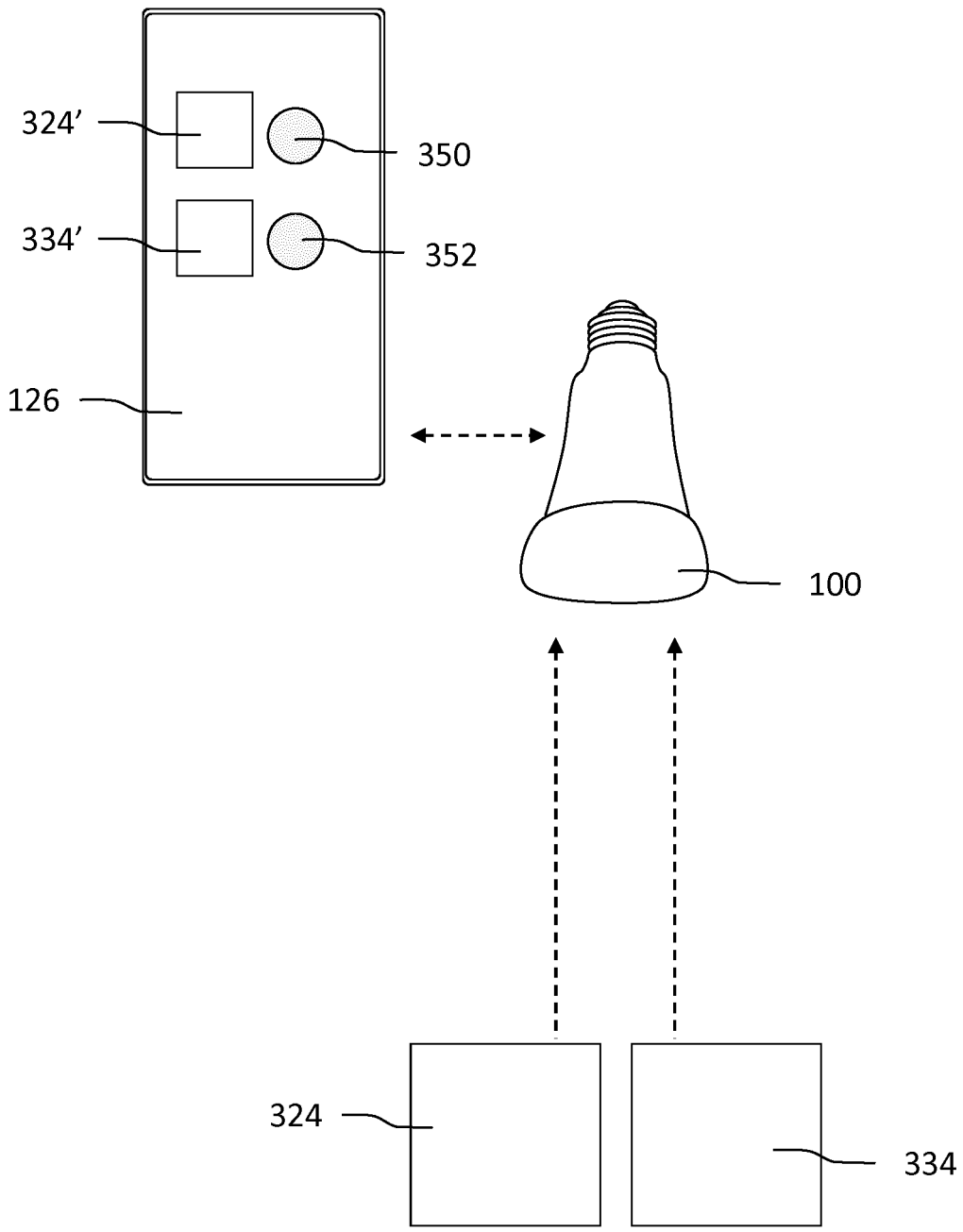
FIG. 3 shows schematically an embodiment of a system comprising a lighting device, a configuration device comprising a user interface and two lighting control devices.

FIG. 3 shows schematically an embodiment of a system comprising a lighting device 100, a configuration device 126 comprising a user interface and two lighting control devices 324, 334. The first lighting control device 324 comprises a first user input element (not shown) and the second user input element 334 comprises a second user input element (not shown). A first processing unit of the first lighting control device 324 may be configured to communicate a first lighting control command to the lighting device 100 when the first user input element is actuated. A second processing unit of the second lighting control device 334 may be configured to communicate a second lighting control command to the lighting device 100 when the second user input element is actuated. Initially, the first light setting (e.g. red light) may be associated with the first lighting control command of the first lighting control device 324 and with the second lighting control command from the second lighting control device 334. The processor (not shown) of the lighting device 100 may therefore control the light source (not shown) according to the first light setting (e.g. red light) upon receiving the first or the second lighting control command. The configuration device 126 (e.g. a smartphone) may be configured to request a current configuration of the lighting device 126, and render current light settings associated with input elements of the lighting control devices 324, 334. FIG. 3 shows a first virtual representation 324' of the first lighting control device 324 and a second virtual representation 334' of the second lighting control device 334, and their corresponding configuration, wherein upon activation of the first lighting control device 324 the light source will be controlled according to a first color 350 (e.g. red) and wherein upon activation of the second lighting control device 334 the light source will be controlled according to the same color 252 (e.g. also red), as the first light setting is associated with the first lighting control command and with the second lighting control command. A user may then, for instance, select one of the colors, for example the first color 350, and change that color with a color picker (e.g. from red to blue). The configuration device 126 may then send a configuration command to the lighting device 100 comprising information regarding the changed first color (e.g. blue) of the changed light setting (blue). The processor of the lighting device 100 may then store an association between the changed light setting (blue) and the first lighting control command in the memory and maintain the association between the first light setting (red) and the second lighting control command, upon receiving the configuration command. As a result, the light source would be controlled according to the changed first color (blue) when a user would actuate the first user input element of the first lighting control device 324, while the light source would be controlled according to the original first color (red) when a user would actuate the second user input element of the second lighting control device 334.

The second light setting (and/or the first light setting) may be a dynamic light setting. A dynamic light setting may be a light setting that changes its light output over time. The dynamic light setting may be a sequence of light settings that transition into each other over time. The dynamic light setting may be stored in the memory 108 of the lighting device 110, which removes the need of transmitting the individual light settings to the lighting device over time.

Figure 4:
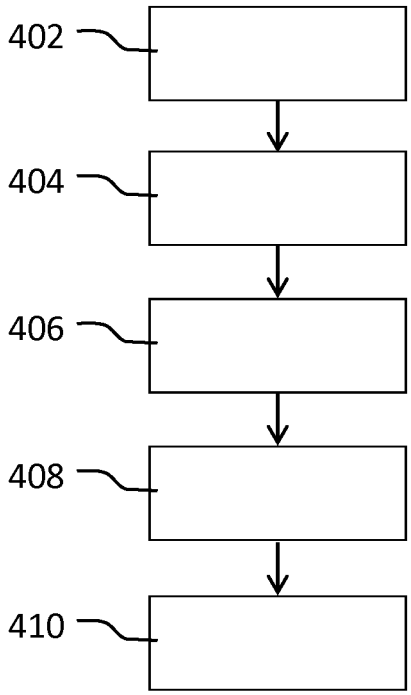
FIG. 4 shows schematically a method of configuring a lighting device.

FIG. 4 shows schematically a method 400 of configuring a lighting device 100 comprising a light source 102 and a memory 108. The method comprises the steps of receiving 402 a lighting control command from a lighting control device 124 via a first wireless communication technology 114, controlling 404 the light source 102 according to a first light setting associated with the lighting control command upon receiving the lighting control command from the lighting control device 124, receiving 406 a configuration command from a configuration device 126 via a second wireless communication technology 116, wherein the configuration command comprises information related to a second light setting, storing an association between the second light setting and the lighting control command in the memory 108 upon receiving the configuration command, and controlling the light source 102 according to the second light setting upon receiving the same lighting control command after the association has been stored.

The method 400 may be executed by computer program code of a computer program product when the computer program product is run on a processing unit of a computing device, such as the processor 110 of the lighting device 100.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors or even the 'cloud'.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A lighting device comprising:

a light source, a first communication module configured to communicate via a first wireless communication technology, and configured to receive a lighting control command from a lighting control device via the first wireless communication technology, a second communication module configured to communicate via a second wireless communication technology, and configured to receive a configuration command from a configuration device via the second wireless communication technology, wherein the configuration command comprises information related to a second light setting, a memory, a processor configured to control the light source according to a first light setting associated with the lighting control command upon receiving the lighting control command from the lighting control device, wherein the processor is further configured to store an association between the second light setting and the lighting control command in the memory upon receiving the configuration command, and wherein the processor is further configured to control the light source according to the second light setting upon receiving the same lighting control command after the association has been stored.

2. The lighting device of claim 1, wherein the second communication module is configured to receive a request message from the configuration device, and wherein the second communication module is further configured to communicate information related to a current configuration of the lighting device to the configuration device, wherein the current configuration relates to at least one current association between a light setting and a lighting control command.

3. The lighting device of claim 1, wherein the current configuration further relates to properties of the lighting control device.

4. The lighting device of claim 1, wherein the memory is configured to store the first light setting, and wherein the processor is configured to overwrite the stored first light setting with the second light setting.

5. The lighting device of claim 1, wherein the memory is configured to store the first and the second light setting, and wherein the processor is configured to remove a link between the first light setting and the lighting control command and link the second light setting to the lighting control command upon receiving the configuration command.

6. The lighting device of claim 1, wherein the processor is configured to change the light output of the lighting device after the association has been stored to indicate to a user that the association has been stored.

7. The lighting device of claim 1, wherein the first light setting is associated with a first lighting control command of a first lighting control device and with a second lighting control command from a second lighting control device, and wherein the processor is configured to control the light source according to the first light setting upon receiving the first or the second lighting control command, and wherein the configuration command further comprises an indication that the second light setting is to be associated with the second lighting control device, and wherein the processor is further configured to store or maintain a first association between the first light setting and the first lighting control command and store a second association between the second light setting and the second lighting control command in the memory upon receiving the configuration command, and wherein the processor is further configured to, after the association has been stored, control the light source according to the first light setting upon receiving the first lighting control command from the first lighting control device and to control the light source according to the second light setting upon receiving the second lighting control command from the second lighting control device.

8. The lighting device of claim 1, wherein the first wireless communication technology is a multi-hop communication technology, and wherein the wireless communication technology is a point-to-point communication technology.

9. The lighting device of claim 1, wherein the lighting control command is received from the lighting control device after actuation of a user input element of the lighting control device.

10. The lighting device of claim 1, wherein the configuration device is a mobile user device.

11. The lighting device of claim 1, wherein the second light setting is a dynamic light setting.

12. A system for configuring a lighting device, the system comprising:

the lightning device of claim 1, and a lighting control device configured to transmit a lighting control command to the lighting device via the first wireless communication technology.

13. The system of claim 12, further comprising a configuration device, wherein the configuration device comprises:

a user interface configured to receive a user input indicative of a selection of a second light setting, and a transmitter configured to transmit a configuration command comprising information related to the second light setting to the lighting device.

14. A method of configuring a lighting device comprising a light source and a memory, the method comprising:

receiving a lighting control command from a lighting control device via a first wireless communication technology, controlling the light source according to a first light setting associated with the lighting control command upon receiving the lighting control command from the lighting control device, receiving a configuration command from a configuration device via a second wireless communication technology, wherein the configuration command comprises information related to a second light setting, storing an association between the second light setting and the lighting control command in the memory upon receiving the configuration command, and controlling the light source according to the second light setting upon receiving the same lighting control command after the association has been stored.

15. A computer program product for a computing device, the computer program product comprising computer program code to perform the method of claim 14 when the computer program product is run on a processing unit of the computing device.

* * * * *